United States Patent [19]

Danti

[11] 4,220,272

[45] Sep. 2, 1980

[54] PRECISION CUTTING MEANS

[76] Inventor: Bernard R. Danti, 235 Bedford St., Lexington, Mass. 02173

[21] Appl. No.: 955,873

[22] Filed: Oct. 30, 1978

[51] Int. Cl.[2] ..... B26F 3/00

[52] U.S. Cl. ..... 225/2; 83/51; 83/103; 83/322; 83/885; 93/36 A; 225/97

[58] Field of Search ..... 225/2, 96, 97, 95, 96.5; 93/36 A; 83/51, 103, 885, 322

[56] References Cited

U.S. PATENT DOCUMENTS

| | | | |
|---|---|---|---|
| 2,141,492 | 12/1938 | Southwick | 83/51 X |
| 2,390,072 | 12/1945 | Beaton | 83/51 |
| 3,263,882 | 8/1966 | Nugent et al. | 225/97 X |
| 3,524,364 | 8/1970 | Bishop | 93/36 A X |
| 3,878,746 | 4/1975 | Carmeli | 83/51 X |

*Primary Examiner*—Frank T. Yost

*Attorney, Agent, or Firm*—Andrew F. Kehoe; Robert A. Cesari; John F. McKenna

[57] ABSTRACT

Precision cutting means adapted for use in cutting, e.g., small holes along a continuous web. The novel apparatus by which the process of the invention is to be carried out comprises opposed cutting means, mounted on either side of a path through which a web to be processed is moved. Each cuts only part way through the web, the cuts from each side being in exact register and leaving a blank which is secure until it is removed by positive mechanical action.

3 Claims, 5 Drawing Figures

PRECISION CUTTING MEANS

BACKGROUND OF THE INVENTION

This invention relates to web-shaping apparatus which utilizes means to cut precision shapes into a web; the apparatus may also be used to continuously fabricate precision-shaped stampings out of a web. In its most immediate utility the invention relates to a means to place a series of spaced, precisely-sized and precisely-placed holes, i.e., to perforate a non-elastomeric polymer web such as a movie film or the like.

Perforation of movie films is an unusually critical process, not only in the precision of the perforation dimensions, but the quality of the surface in and about the punched hole must be high. Also, the perforating of movie film requires precise control of pitch dimensions of the punching tools so that the picture image on the screen will be steady. Obtaining these characteristics is all the more difficult because manufacturing operations are usually carried out in the dark. Moreover, the expense of film materials is so high that it is most desirable that the operations be carried out with as little scrapped product as is possible.

The equipment which is currently used to perform this operation presents many problems:

1. There is a great deal of drift in the repeat lengths of perforation dimensions which is caused by the intermittent motion of a shuttle feed which is intended and designed to be highly precise. Such feed devices, as a practical matter, cause over-feed because of clearances in the feed mechanism and because of inertial forces set up by reciprocating masses.
2. Over-feed, in turn, leads to improper entry of piloting guides of the feed apparatus into previously punched holes. This distorts the finish of the hole perimeter and, eventually, leads to misfeeds and subsequent material jams. The result is excessive scrap product.
3. The small cross-section, combined with the length of the tool, results in slender punching tools that are excessively fragile. This slenderness, together with the extremely small clearances between reciprocating punch and die members leads to frequent tool breakage and rapid wear of expensive tooling. At that, this problem is made even more critical by any misfeeding of the web material.
4. The hard punch and die components of the prior art are formed of exceptionally hard materials such as carbide. These are not altogether satisfactory because they are, in the applicable dimensions, excessively brittle, and they do not stand up as long as one would like under the repeated contact of one with the other.
5. It is often desirable to slit movie films. Since slitting is best accomplished under continuous web motion conditions, the current perforating machinery is not well suited for use with a concurrent slitting process. As a result, separate slitting operations are commonplace in film manufacturing processes. Of course, the requirement for such operations greatly increases material handling costs during manufacture.
6. Splice tapes, which are conveniently and frequently used in photographic film manufacturing processes, cause havoc with the present commercial equipment.
7. There is an extremely high maintenance factor associated with this machinery, each machine requiring many sets of spare tooling and spare parts, all of which lead to large capital investments.

In a hindsight search for prior art made only after the invention to be described in this specification was made, the following patents were turned up:

U.S. Pat. No. 3,430,542
U.S. Pat. No. 3,524,364
U.S. Pat. No. 3,391,589
U.S. Pat. No. 4,303,607
U.S. Pat. No. 3,526,163
U.S. Pat. No. 3,528,330

Most of the apparatus described in these patents disclose means for cutting and removing blanks from continuously-processed webs. None of it is believed to disclose the important improvements made by the inventor and described hereinbelow.

SUMMARY OF THE INVENTION

The principal object of the present invention is to provide an improved process for precision cutting of apertures in webs and the apparatus for carrying out such an improved process.

It is the particular object of the invention to provide means to place a series of precisely placed and sized apertures in a continuously-moving web.

It is also an object of the invention to provide apparatus which will provide an improved, burr-free finish in and about apertures or other cutting configurations.

Another object of the invention is to provide novel cutting means to aid achievement of the aforesaid objects.

Other objects of the invention are to achieve the above objects at a reasonable cost, with minimal maintenance expense, and, with a lengthened life for cutting tools.

Other objects of the invention will be obvious to those skilled in the art on their reading of this invention.

The above objects have been substantially achieved by a process wherein an web of material, which is to be subjected to the precision cutting action, is passed between two cutting edges, one above and one below the sheet cut. Each cutting edge substantially corresponds to the shape of the hole to be cut in the sheet. These edges, in precise registration with one another, cut into the sheet with cutting action from above and from below said web. This cutting action is limited so that the cut proceeds only to a point where each cutting edge is proximate to the center of the cross-section of such web, but is separated from the other by a thin, readily-removable, breakable, portion of uncut material. Thereupon the web passes on to a mechanical means for punching out, or otherwise removing, the material corresponding to the shape of the hole being cut. This is conveniently done by a gentle push or impact.

A class of materials advantageously processed are the non-elastomeric organic polymers, i.e. plastics. The cutting action is carried out simultaneously by substantially-identically shaped cutting edges. In some particularly advantageous embodiments of the invention, each limited cutting action is carried out by each of a plurality of cutting edges mounted for rotation above and below said web, respectively. This is believed to provide an excellent way to achieve good cut quality at the leading and rearmost sections of the aperture as it travels through its process path. The rotating cutting edges conveniently form means to advance said web towards an apparatus for mechanically removing said uncut material. The uncut material is mechanically knocked out leaving a clean finished hole about its entire perimeter.

Many different types of materials can be processed by the invention. Plastics, metals, paper and the like are illustrative of the sheet materials which may be processed. In general, the materials should not be elastomeric at the processing temperature. It is to be noted that the product may be an apertured or shaped web as in the specific process illustrated below. However, in an appropriate circumstance, the product of the process may be the clean-edged, precisely-shaped, article which is stamped from the continuous web. In the latter case, the quality of the cut rather than its position in the web is a major factor determining the value of the process.

It will also be noted that the terms "above" and "below" a web are to be taken to refer to the normal attitude of web processing procedures. However, cutting implements on either side of a vertically mounted web would function equivalent; and, indeed, one aspect of the present invention is its ready adaptation to a vertical web processing installation which would save substantial floor space.

ILLUSTRATIVE EXAMPLES OF THE INVENTION

In this application and accompanying drawings there is shown and described a preferred embodiment of the invention and suggested various alternatives and modifications thereof, but it is to be understood that these are not intended to be exhaustive and that other changes and modifications can be made within the scope of the invention. These suggestions herein are selected and included for purposes of illustration in order that others skilled in the art will more fully understand the invention and the principles thereof and will be able to modify it and embody it in a variety of forms, each as may be best suited in the condition of a particular case.

IN THE DRAWINGS

Figure 1:
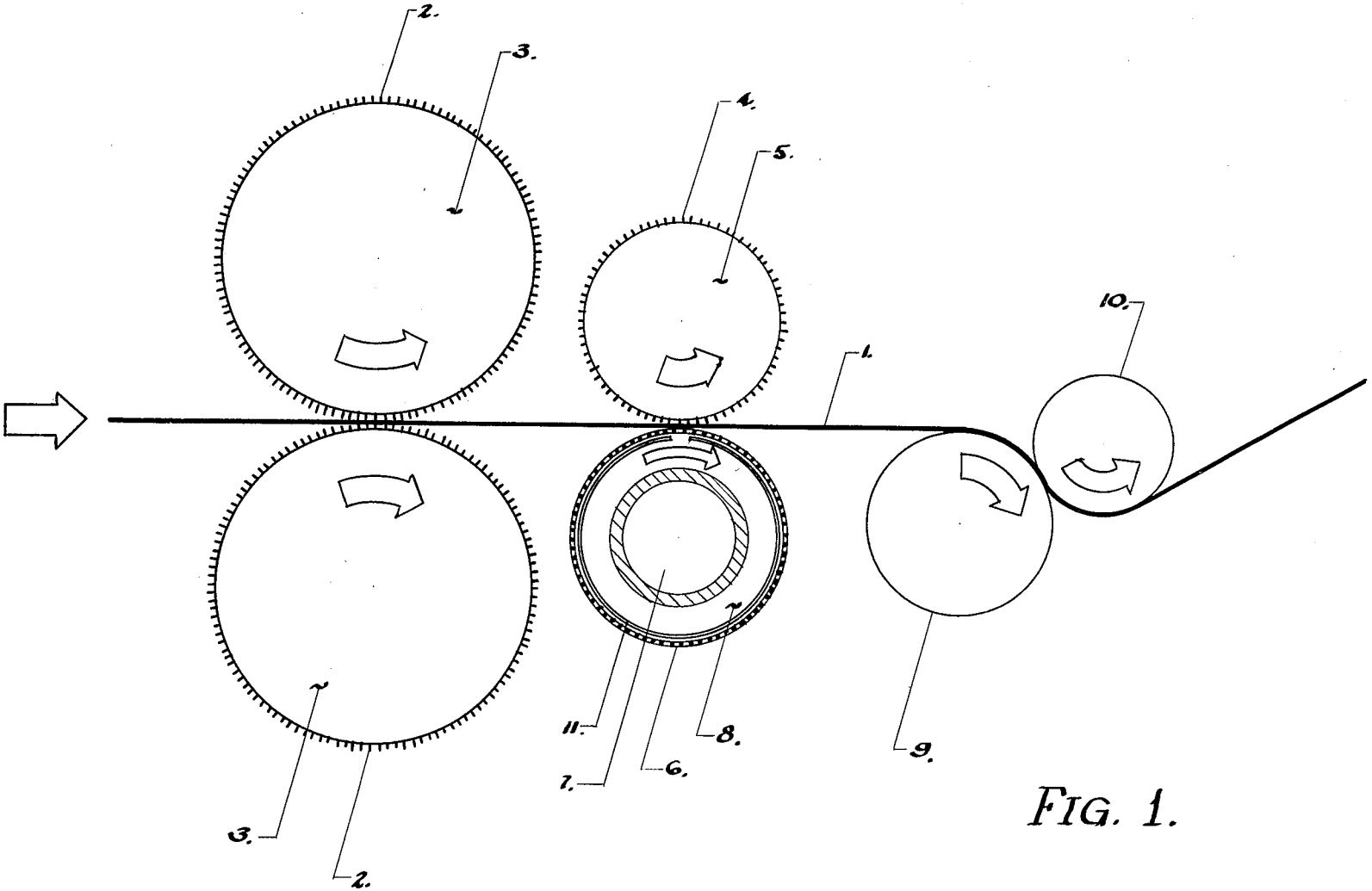
FIG. 1 is a schematic diagram showing the elements and sequence of the process of the invention.
Figure 2:
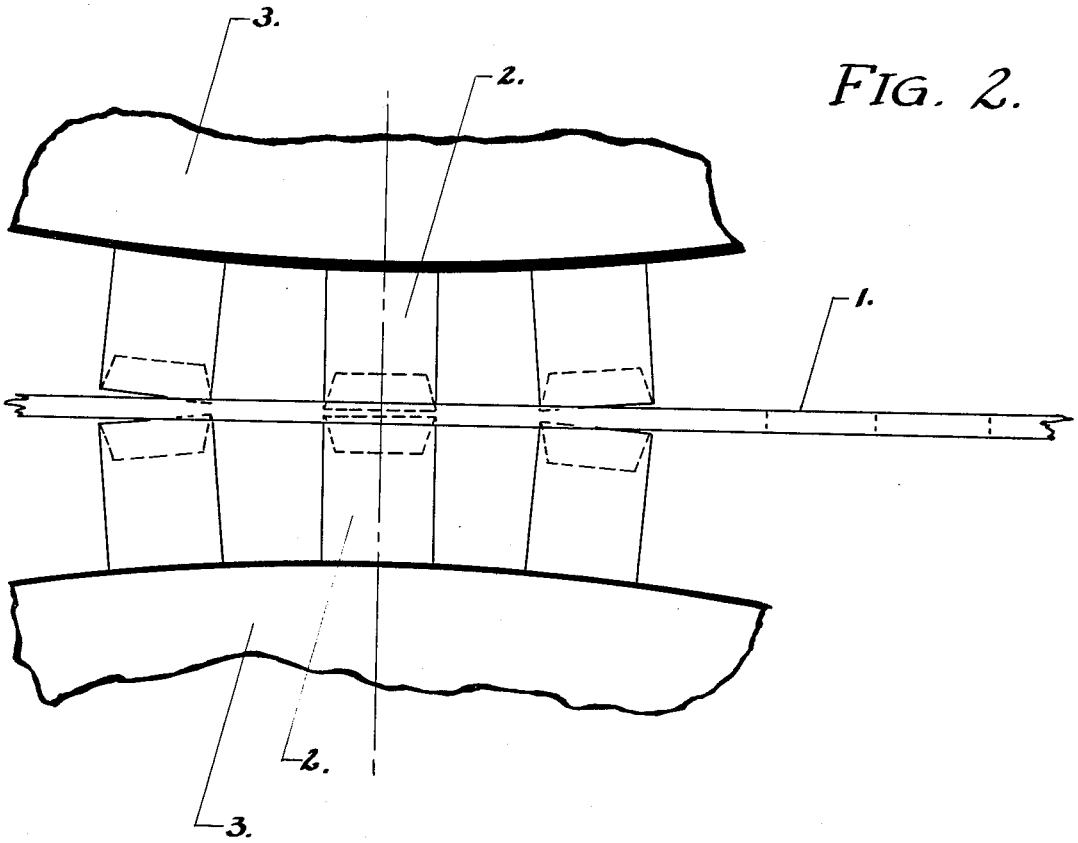
FIG. 2 is an enlarged drawing showing the sequential action of an apparatus of the invention at a scoring, or partial cutting station.
Figure 3:
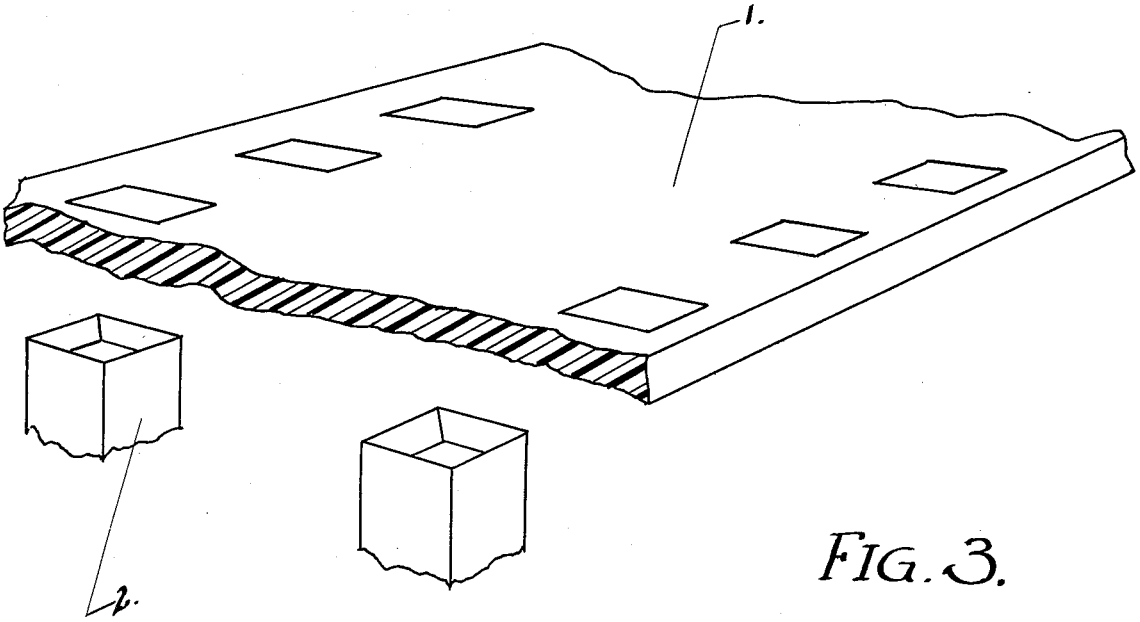
FIG. 3 is a perspective indicating two lower cutting tools and relationship to a web being processes processed.
Figure 4:
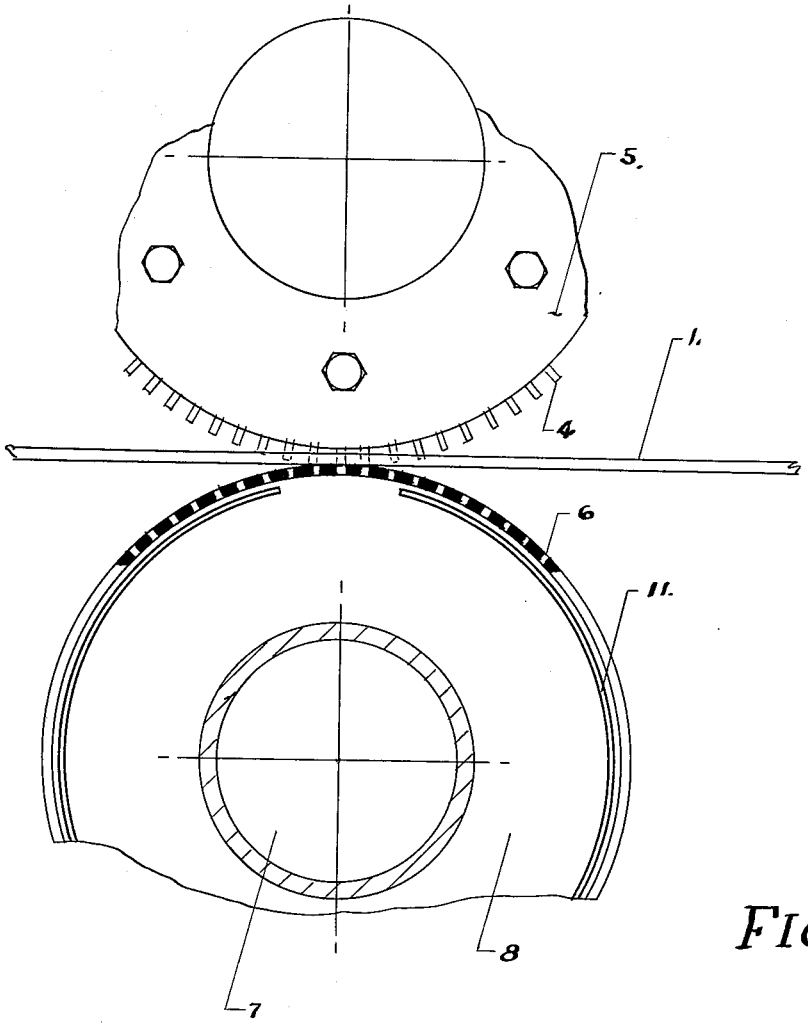
FIG. 4 is a perspective indicative of the action of a punch out- or debris-collecting apparatus.
Figure 5:
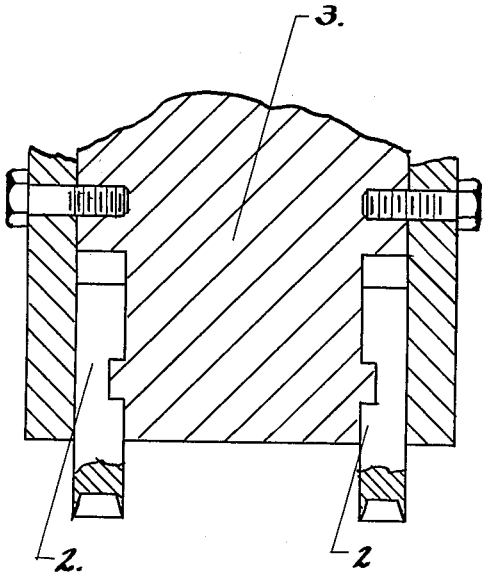
FIG. 5 shows the position of upper cutting tools in relationship to the apparatus on which they are mounted.

Referring to FIG. 1, it will be seen that the web material 1 to be perforated is fed from an unwind stand (not shown) in a uniform continuous fashion to web-perforating apparatus 20 comprising rotating tooling stations 22 and 24. A set of feed rollers 9 and 10 aids in moving the web towards a slitting station at 24. The resulting product is then packaged on reels as known in the art.

The first station is a scoring station 22. Scoring punches 26 are precisely aligned on two rolls and are set so that they cut into the web 1 from each side. These scoring punches 26 never contact each other or any other metal part which has relative motion to them. In a film base of 0.005" thickness, for example, these punches 26 can enter a cinematographic film material by 0.0017" per side and be clear of each other on the center line as at 28 by about 0.0016".

The punch-bearing rolls 3 run at a controlled velocity and serve as means to meter the material 1, continuously feeding it through the web processing line.

The scored material feeds subsequently to the knock-out station 24, where a punch 4 passes through the material and intersects the scrap removal path formed by aperture 6 in conjugate fashion. Since the material has been previously scored and weakened about its entire periphery and relies upon the knock-out action only for a breaking action rather than any cutting, there can be relatively large clearances between the knock-out punch and the scrap removal path. This greatly simplifies the manufacture and operating control of the knock-out punch and the scrap removal path. Thus, the hole forming the scrap removal path can be larger than the scrap knocked out of the perforated hole. This greatly facilitates removal of the scrap by a vacuum system.

The system also allows for a limited amount of relative motion between the web 1 and the knock-out punch roll 5 and the vacuum chamber 8. The very slight differences in pitch dimension which are normally encountered between the scoring section and the knock-out section can, therefore, be accommodated by a differential slip between the web and the knock-out section elements. Modulation or phasing of the knock-out section elements with respect to the scoring section elements is within the state of the art of current technology, e.g. technology relating to stepper motor drives.

The drive is a system which controls the web tension between the scoring section, the knock-out section, the slitter and the drive.

It is also to be understood that the following claims are intended to cover all of the generic and specific features of the invention herein described and all statements of the scope of the invention which might be said to fall therebetween.

What is claimed is:

1. A process for placing a series of holes or predetermined shape and spacing into a thin web of material, said process comprising the steps of (a) passing said web between two cutting edges, one above and one below said sheet and each substantially corresponding to the shape of the hole to be cut;

(b) cutting simultaneously into said web with cutting actions by said cutting edges from above and cutting action by said cutting edge from below said web;

(c) limiting said cutting actions so that they proceed only to a point where said cutting edges are proximate to the center of the cross section of such web, but are separate one from other relatively easily by a removable portion of uncut material; and (d) mechanically removing said material forming said shape of hole to be cut; wherein said material being cut is a non-elastomeric organic polymer, and said cutting action is carried out simultaneously by substantially-identically shaped cutting edges; wherein said cutting edges mounted for rotation above and below said web, respectively form means to advance said web toward an apparatus for mechanically removing said uncut material; and wherein said mechanical removing of said uncut material by mechanically knocking such material out of said holes and simultaneously destroying an uncut perimeter of said hole.

2. A process as defined in claim 1 wherein said web being cut is about 0.005 inches in thickness and wherein said penetration of said edges into said web is about 0.0017 inch.

3. A process as defined in claim 1 or claim 2 wherein said clearance of said edges from one another is less than the penetration of each edge into the web of material.

* * * * *